US006955302B2

(12) United States Patent
Erdman, Jr.

(10) Patent No.: US 6,955,302 B2
(45) Date of Patent: Oct. 18, 2005

(54) REMOTE MONITORING DIAGNOSTICS

(75) Inventor: Clair Ernest Erdman, Jr., New Cumberland, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/712,135

(22) Filed: Nov. 13, 2003

(65) Prior Publication Data

US 2005/0103874 A1 May 19, 2005

(51) Int. Cl.[7] ..... G05D 23/00; F25B 49/00

(52) U.S. Cl. ..... 236/51; 236/94; 62/126; 62/129; 340/585

(58) Field of Search ..... 236/51, 94; 62/125, 62/126, 129; 340/584, 585

(56) References Cited

U.S. PATENT DOCUMENTS

| | | | | |
|---|---|---|---|---|
| 5,390,206 | A | 2/1995 | Rein et al. | |
| 6,064,310 | A * | 5/2000 | Busak et al. | 340/588 |
| 6,176,436 | B1 | 1/2001 | Gauthier et al. | |
| 6,471,486 | B1 | 10/2002 | Centers et al. | |
| 6,474,084 | B2 | 11/2002 | Gauthier et al. | |
| 6,499,305 | B2 | 12/2002 | Pham et al. | |
| 6,529,590 | B1 | 3/2003 | Centers | |
| 6,533,552 | B2 | 3/2003 | Centers et al. | |
| 6,535,138 | B1 | 3/2003 | Dolan et al. | |
| 6,587,739 | B1 | 7/2003 | Abrams et al. | |
| 6,647,735 | B2 * | 11/2003 | Street et al. | 62/132 |
| 6,675,591 | B2 * | 1/2004 | Singh et al. | 62/129 |
| 2002/0163436 | A1 * | 11/2002 | Singh et al. | 340/584 |
| 2004/0159113 | A1 * | 8/2004 | Singh et al. | 62/129 |

* cited by examiner

*Primary Examiner*—Marc Norman
(74) *Attorney, Agent, or Firm*—McNees Wallace & Nurick LLC

(57) ABSTRACT

A system for remotely monitoring operations of an HVAC system such as a chiller system having a control center, or a rooftop unit. The system utilizes a remote monitoring unit (RMU) located on-site. The RMU is in one-way communication with the component of the air conditioning system and receives data indicative of the operation of the component and determines whether the component is operating outside the normal operating parameters. When the RMU determines, from the data, that there is a problem that is within a critical parameter range, then a critical alarm is generated and the RMU opens a line of communication with a remote monitoring diagnostics device (RMD) located at the facility of the HVAC or refrigeration manufacturer and downloads the information to the RMD which determines whether remedial action is required and initiates remedial action if required.

38 Claims, 3 Drawing Sheets

REMOTE MONITORING DIAGNOSTICS

FIELD OF THE INVENTION

The present invention is directed to system of remotely monitoring a chiller or a rooftop unit of an air conditioning system.

BACKGROUND OF THE INVENTION

Rooftop units are assembled onto the flat roofs of structures such as supermarkets, office buildings and other commercial structures. These units are factory assembled and tested, needing only to be hoisted to the roof at the site for installation. A rooftop unit may be used for heating, cooling or both.

Chillers, or chilled water units, are cost-effective systems that utilize both water and refrigerant. Chillers remove heat from the water, which is then circulated through other components in the system. Water is an excellent secondary refrigerant because it is readily available, inexpensive, non-toxic and substantially non-corrosive. It also has a favorable specific heat value. Other secondary refrigerants can also be used, depending upon the application. These include calcium chloride or sodium chloride brines, methanol, propylene glycols, ethylene and glycerin. Chillers are frequently used for commercial air conditioning and industrial process cooling as well as for low temperature refrigeration. While there are various types of chillers, which may include many different components, a chiller typically includes a compressor, a motor and a control center, which may be in the form of a microprocessor control. A compression chiller will include, in addition to the above equipment, a condenser, an evaporator and a metering device.

Various literature is available discussing the benefits of remote monitoring of HVAC systems. One such patent to Sandlemen et al., U.S. Pat. No. 6,535,123 B2 issued Mar. 18, 2003, discusses the remote monitoring of electric and/or mechanical equipment such as HVAC equipment. It discloses using a sensor to monitor the state of at least one parameter of the equipment and communicating a message indicative of the equipment state to a locally connected interface unit which is in communication with a computer server. A user can remotely access the computer server through a user interface to configure outgoing message routing instructions. When a sensor detects an exception condition, the interface unit forwards a message indicative of the exception condition to the server, which forwards it to at least one predetermined user-defined remote communication device based on the incoming exception message. An "exception condition" occurs whenever the equipment operates outside of its preferred parameters, and an error message is transmitted to a recipient indicative of the condition unless the feature is disabled.

Such systems suffer from a few inadequacies. First, it fails to recognize that chillers, and frequently rooftop units, already include sensors that monitor operational parameters and transmit this information to the control center. Therefore, it would be beneficial if the information available at the on-site control centers could be utilized to provide valuable information indicative of system operation to a remotely located individual, rather than rerouting the information transmitted from the sensors to such equipment as discussed in U.S. Pat. No. 6,535,123 B2. The control centers provided with chillers differ for each chiller manufacturer, and so accessing the information received by the control centers can prove to be more difficult than rerouting information transmitted from the sensors to such equipment or providing new sensors.

Systems such as discussed in U.S. Pat. No. 6,535,123 B2 provide for initiation of two-way communication between the user and the remotely located site, as discussed in the patent. This two-way communication, particularly when set up to operate over the Internet, is subject to mischief by hackers who can cause false exception messages necessitating unnecessary technician service calls, or worse, shutting down the equipment.

Current methods of monitoring the operation of chillers or rooftop units of air conditioning systems currently do not provide the capability to both remotely diagnose an existing problem or anticipate the occurrence of a problem that could result in shut down or improper operation of equipment. One of the results of the current methods is that service technicians are called to the site of the chiller or rooftop units when repairs are not required. Alternatively, the service technicians may be dispatched to a repair site and may not have the correct parts or equipment to repair the malfunctioning unit. In another scenario, the technicians are dispatched to repair a malfunctioning unit on an emergency basis, frequently at inconvenient times, after a failure has occurred. For the technician, this means reduced productivity. More importantly, it can result in reduced performance to other customers, as the technician(s) is required to respond to reports of malfunctioning units on an emergency basis.

A system of remotely monitoring a chiller system that utilizes information from the control center of the unit would be beneficial. While the system of monitoring is remote and provides important information about the operation of the system, such a system should not, for security reasons, allow a remote user to gain access to the information in the system from his remote location.

SUMMARY OF THE INVENTION

The present invention is a system for remotely monitoring operations of a heating ventilating and air conditioning (HVAC) system such as a chiller system having a control center, or a rooftop unit. The system utilizes a remote monitoring unit (RMU) located on-site, that is to say, at the facilities at which the chiller system or rooftop unit is located. The RMU is in one-way communication with a component of the air conditioning system and receives data indicative of the operation of the component and determines whether the component is operating outside the normal operating parameters. The RMU stores data indicative of component operation in memory. If the data indicates that the unit component is operating outside of normal parameters, an alarm is generated and the fact that an alarm was generated and the data causing the generation of the alarm also is stored in memory. The RMU continues to monitor the source of the alarm to determine whether the alarm was caused by a temporary excursion outside of the normal parameters. If the RMU determines that the alarm was caused by temporary excursion, the RMU resets the alarm and returns to normal operation.

If the RMU determines, from the data, that there is a problem, the RMU then determines whether the operation is within a critical parameter range. If the data indicates that the operation is within a critical parameter range, the RMU generates a critical alarm. If the data indicates that the operation of the unit is outside of normal parameters for a preselected period of time, the RMU generates a warning alarm. The generation of a warning alarm or a critical alarm causes the RMU to open a line of communication with a remote monitoring diagnostics device (RMD). The RMD is located at the facility of the HVAC or refrigeration manufacturer, and therefore is remote from the site location of the chiller or rooftop unit. The RMU downloads the critical or warning alarm information and the data resulting in the alarm to the RMD. The RMD evaluates the information and determines whether remedial action is required. If remedial action is required, the RMD initiates the remedial action to correct the cause of the warning alarm or the critical alarm. This remedial action may involve providing information to engineering at the manufacturer's facility, hereinafter referred to as engineering services, whose task is to analyze and evaluate data, and determine whether repair or maintenance is required and when. If the RMD determines that no remedial action is required, the RMD recognizes that there is no problem and that the RMU will reset itself.

One advantage of the present invention is that the diagnostic system of the present invention allows an owner of a building to have the HVAC system monitored by the manufacturer of the equipment, thereby eliminating or reducing the owner's need to make a decision regarding the equipment.

Another advantage of the present invention is that when a problem is detected, the manufacturer of the HVAC equipment at his facility can directly analyze the data, where he will have the engineering expertise to determine the appropriate corrective action to implement with regard to the equipment.

Still another advantage of the present invention is that the manufacturer can determine whether an alarm is a false alarm requiring no action, a serious problem requiring immediate action, or a problem that can be corrected during routine maintenance. In this way, the number of unnecessary service calls can be minimized and more efficient use of service technician time can be realized.

A further advantage of the present invention is that when a service call is determined to be required, the technician making the service call can be provided with information regarding the nature of the problem with the equipment and the likely tools and repair parts required to correct the problem.

Yet another advantage of the present invention is that there is a one-way line of communication between the RMU and the component equipment. In addition, the RMU can only contact the RMD to open a line of communication with the RMD. Thus, the risk of mischief from a computer hacker remotely entering the RMU or the component equipment to shut down the component equipment, or to cause the RMU to indicate that the component equipment is malfunctioning is significantly reduced or eliminated.

Yet a further advantage of the present invention is that the equipment manufacturer can analyze equipment operation in order to quickly establish patterns of operational problems with equipment line. In other words, the present invention allows the equipment manufacturer to do real-time reliability analysis and/or trend analysis while also initiating corrective action with an entire equipment line before individual component equipment failures occur, and in certain cases, before critical warnings are generated.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

HVAC equipment requires monitoring to assure that the equipment is operating within specified parameters to assure efficient performance. It is the financial interest of the owner of the equipment to know when the equipment is not operating within specified parameters, as performance outside these parameters can result in higher operating costs in the form of higher energy bills. However, monitoring also may provide information that indicates that routine maintenance is required at intervals that deviate from pre-scheduled intervals. If monitoring indicates that maintenance is required sooner than the pre-scheduled interval, the routine maintenance can be scheduled in advance and inefficient operation can be prevented. If, on the other hand, monitoring indicates that routine maintenance is not required at the pre-scheduled interval, the routine maintenance can be delayed and the owner can avoid payment of an unnecessary routine maintenance check-up. Importantly, monitoring can determine if a serious condition exists in the operation of the equipment than can lead to an imminent shutdown. Furthermore, monitoring can also detect if these conditions are false conditions, or whether the conditions are continuing conditions requiring attention. However, such determination may require the expert evaluation of a HVAC manufacturer who maintains the expertise in the form of an engineering department having the specialized knowledge required for such evaluations. By making such determinations, unnecessary repair visits by service technicians can be avoided, or alternatively, shutdowns to equipment and/or unnecessary damage to equipment can be avoided.

Figure 1:
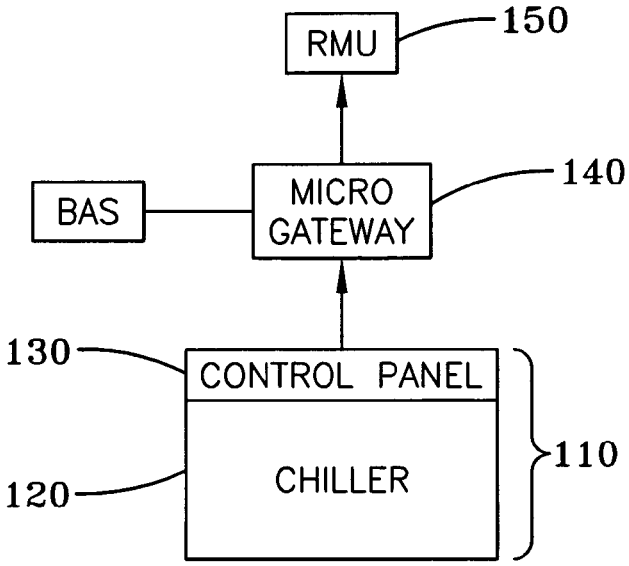
FIG. 1 is schematic of a chiller utilized in the present invention.

Complex HVAC equipment is already monitored. Referring to FIG. 1, a chiller unit 110 is depicted. This chiller unit includes a chiller assembly 120 that has sensors monitoring chiller operation and relaying the data to a control panel 130. The data from the sensors can be stored in memory at the control panel 130, or the operation of the chiller can be monitored at the control panel 130 by viewing the sensor data displayed in digital or analog format. The control panel 130 also may include a number of alarms indicative of past or current chiller operation. However, such monitoring requires access to the chiller unit. In some applications, the control panel 130 can be configured so as to provide the information to a Building Automation System (BAS) located at the building site, so that the chiller assembly operation can be monitored remotely on-site, without requiring a physical presence at control panel 130. Such configuration is best done by the equipment manufacturer when the equipment installation is accomplished. Of course, each manufacturer utilizes a different and frequently proprietary circuit arrangement for the control panel 130, making retrofit of the control panel 130 by anyone but the manufacturer difficult.

The present invention utilizes a microgateway 140 that has been engineered so that it can be connected to a control panel 130 of any major manufacturer's chiller unit 110. Once microgateway 140 has been connected to control panel 130 of chiller unit 110, sensor data information available at the control panel 130 can readily be sent through microgateway 140 via a one-way communication path to another location on-site such as a BAS. In a preferred embodiment, the information is sent to a remote monitoring unit (RMU) 150 that is located on-site. As used herein, the term "on-site" means the geographic, physical location of the equipment, which may be the same building, the same building complex or a campus on which the equipment is located. The RMU 150 does not have to be located at or near the control panel 130 of chiller unit 110. As used herein, the term "remote-site" means a location that is not in the same building, not at the same physical location of the equipment, and not on the same campus on which the equipment is located. The "remote site" may be in the same city, county, state or country as the HVAC equipment, or it may even be in a different country. Communications between the microgateway 140 and another on-site location for monitoring the data, such as RMU 150 may be by any acceptable method including a telephone or modem connection, a network connection, a wireless communication link, e.g. RF or IR, or a dedicated hard-wired line or connection between the microgateway 140 and the other outside location. In a preferred embodiment of the invention, the preferred method of communications is a dedicated line, as this provides the most reliable method of providing information from the microgateway 140.

Figure 2:
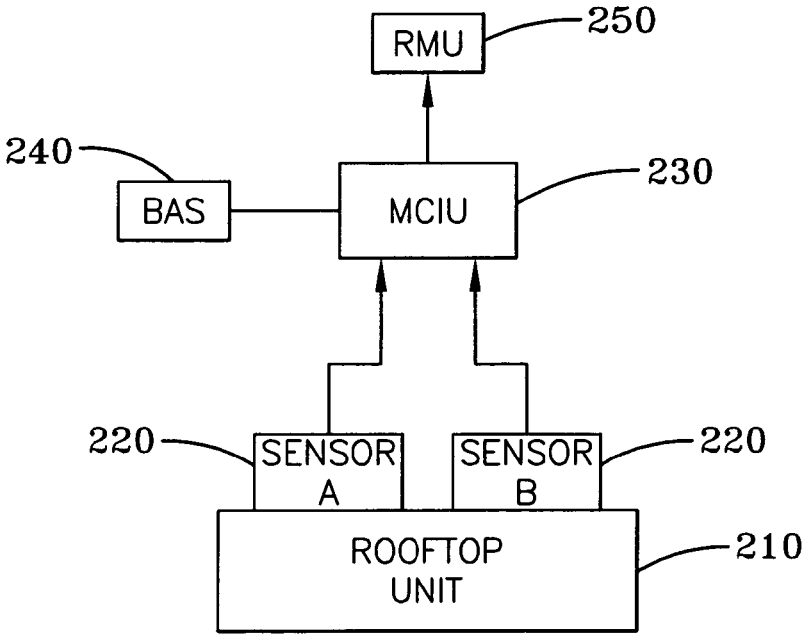
FIG. 2 is a schematic of a roof top unit utilized in the present invention.

Rooftop units (RTU's) typically are not provided with control panels to monitor the operations of the units. When monitoring is desired, the RTU's must be outfitted with sensors, and this is frequently done when the RTU's are included in a BAS, wherein the sensors are hard-wired to the BAS. Referring now to FIG. 2, the present invention includes a rooftop unit (RTU) 210, which is equipped with at least one sensor 220. The at least one sensor 220 is in communication with a monitor control interface unit (MCIU) 230. In a preferred embodiment, the at least one sensor is hardwired to the MCIU 230, and the MCIU 230 is positioned in proximity to the RTU 210, but in a protected location adjacent the RTU 210 so that it will not be damaged by the elements if positioned outdoors. The MCIU 230 is in one-way communication with an RMU 250, which RMU 250 is located on-site. Communications between the MCIU 230 and the RMU 250 may be by any acceptable method including a wireless communication or dedicated lines. In a preferred embodiment of the invention, the preferred method of communications between the MCIU 230 and on-site monitoring equipment is wireless, as this provides the most cost-effective method of providing information from the MCIU 230 due to installation labor costs.

The RMU (150, 250), as noted, is in one-way communication with either a microgateway 140 or an MCIU 230, so that it has the capability to receive information from microgateway 140 or MCIU 230, but not transmit information to microgateway 140 or MCIU 230. The RMU (150,250) can be a computer or other programmable device. The RMU (150,250) includes memory or storage devices to permit it to store operational data from the at least one sensor in a relational database, or in any other suitable manner, that relates the sensor data to other system conditions such as time of day, ambient temperature, or data from other sensors monitoring other operating parameters. The RMU (150, 250) also includes software that allows it to set alarms based on the data transmitted from microgateway 140 or MCIU 230. The RMU (150, 250) stores data related to the alarms and includes logic, programs or software that allows it to evaluate the stored data and make determinations regarding the need for setting alarms. The RMU (150, 250) also has the ability to contact a remote monitoring device as will be discussed further below. A service technician may access the RMU (150, 250) on-site so that the technician can review the operating history of the chiller unit or the RTU 210. Importantly, the service technician has the option of accessing the operational data of the chiller unit 120 or the RTU 210. However, the service technician also may access the alarm information and the underlying data causing the alarms.

Figure 3A:
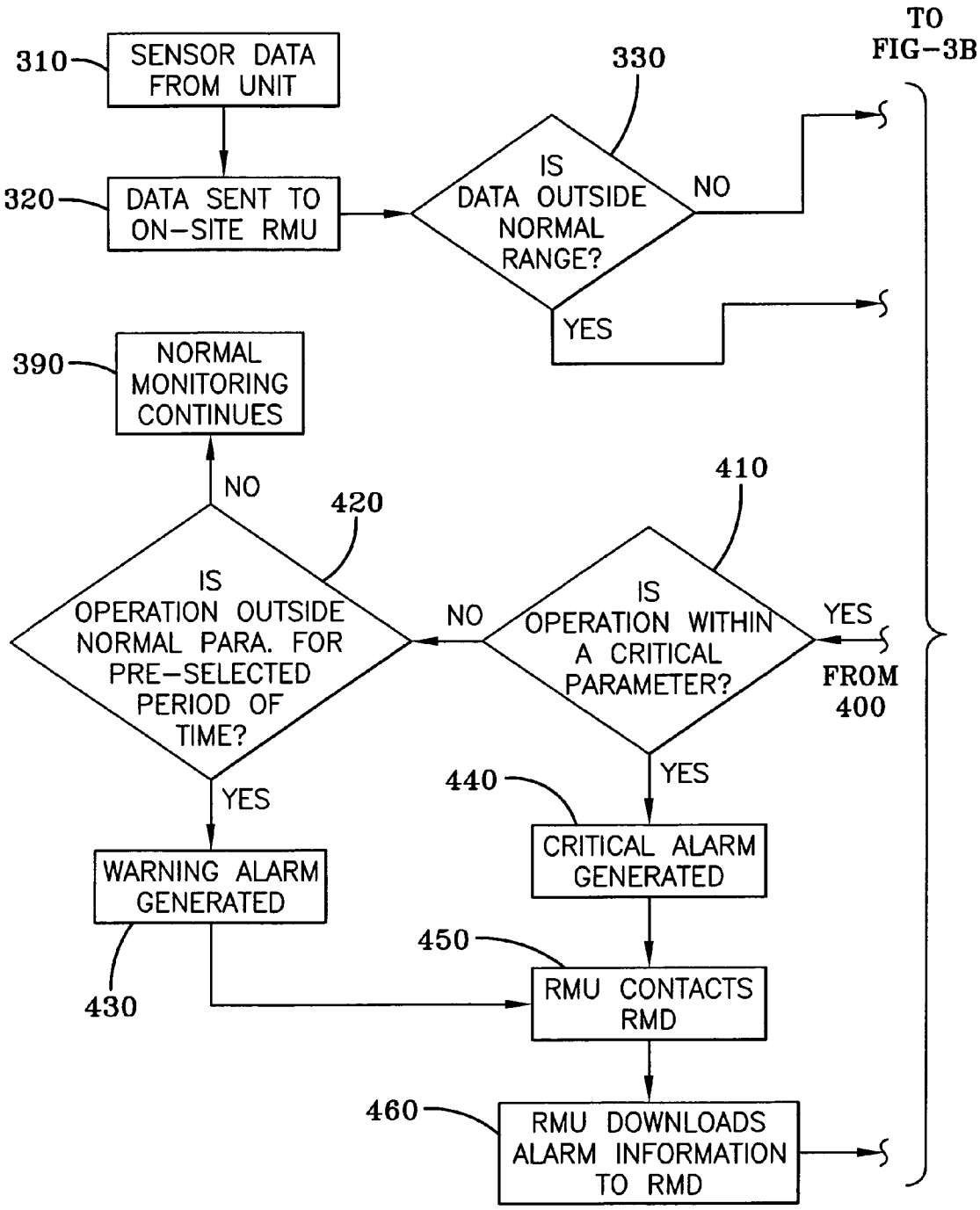
FIG. 3 is a flow chart generally showing the operation of the present invention.
Figure 3B:
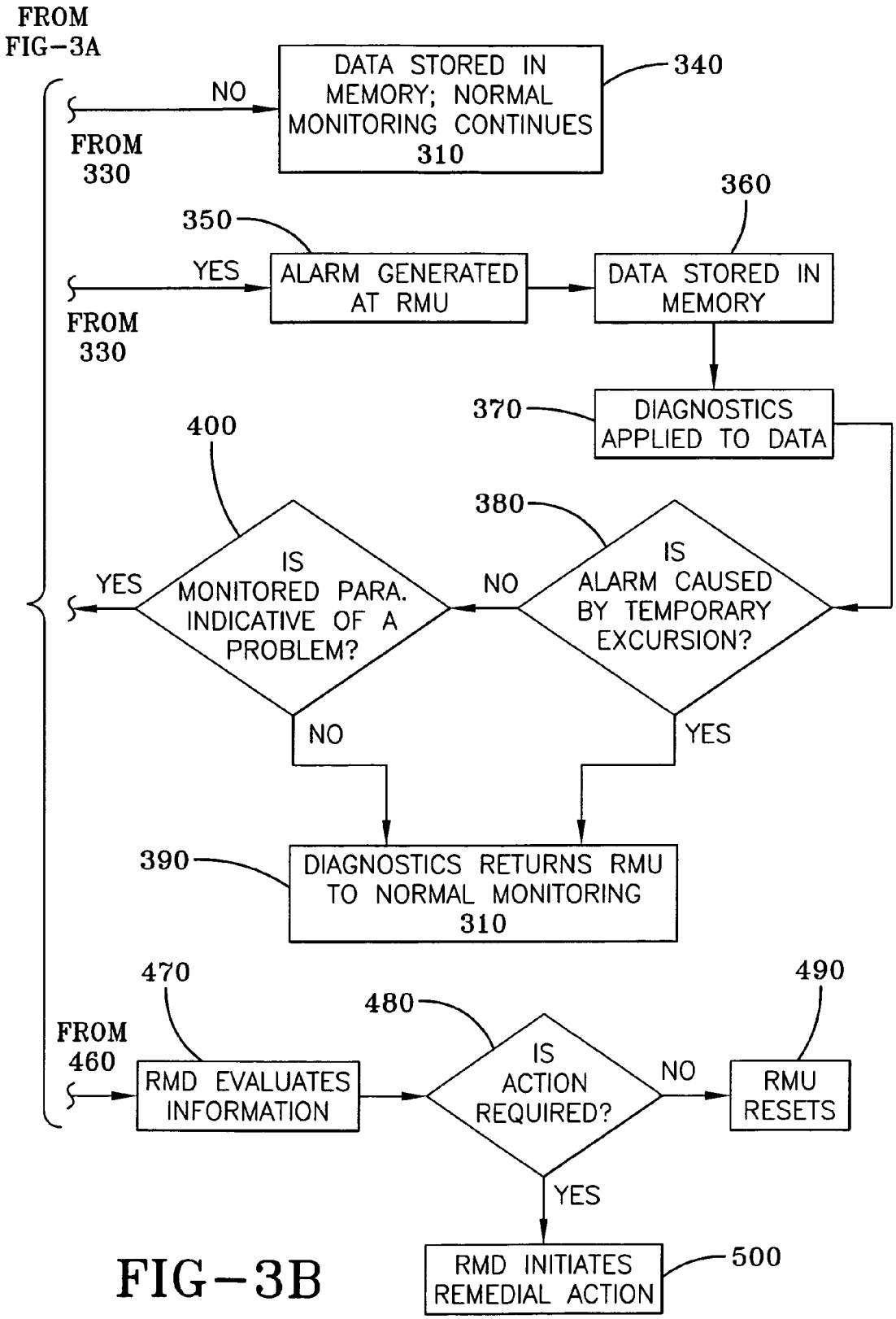

Referring now to FIG. 3, which is a flow chart of the operation of the remote monitoring diagnostics device of the present invention, sensor data is transmitted from a chiller unit or a RTU 210 in step 310. Data from the sensors is typically analog, and desirably is converted to digital data either in control panel 130, microgateway 140, or MCIU 230. However, the data from the sensors could be digital and, as such, no conversion would be necessary. As noted above, in step 320, this data is conveniently sent from a chiller unit 110 to a RMU 150 via a microgateway 140. For RTU 210, the information is sent to the RMU 250 via a MCIU 230. In step 330, the sensor data is periodically evaluated by RMU (150, 250) to determine whether the equipment, either a RTU 210 or a chiller 110, is operating within a normal range. The period or frequency of data sampling can be varied, and is determined by control programs or software. The interval between data samples is sufficiently short to provide an accurate assessment of component operation and may be continuous. The data is compared to normal operational limits that are pre-programmed or pre-set in the RMU (150, 250). If the control software determines that the equipment is operating properly then the data is stored in memory in step 340 at predetermined intervals, and the system continues normal operation. The data can be time-stamped and date-stamped or the data may be sequentially entered into memory or stored on disk and identified by the computer clock, as the time interval between measurements is known. If the control software determines that operation is outside normal operational parameters, then an alarm is generated by the RMU (150, 250) in step 350. The data is still stored in step 360, but the data is marked or coded to indicate that it is out of the operational limits. This can be accomplished in a number of ways. For example, a marker can be applied to the data in the database to indicate that it exceeds the limits, necessitating an alarm. Alternately, the data can be stored in a second database indicative of alarms. Regardless of how the data is marked to indicate that it is outside operational limits, real-time operational data continues to be received by the RMU (150, 250).

After the data has been evaluated by the control software to be outside of operational limits, it is analyzed by diagnostics software or programs in the RMU (150 in step 370. The scope and capabilities of diagnostics software in an RMU may vary from application to application. The diagnostics software can compare and evaluate the data generating the alarm along with other data being received by RMU (150, 250) in step 370 and make a determination as to whether the data causing the alarm was a temporary excursion outside of normal operating parameters, step 380. If the diagnostics software makes such a determination, then the RMU continues to its normal monitoring functions step 390, the information related to the alarm already having been stored in memory in step 360.

The software diagnostics may determine in step 380 that the data causing the alarm in step 350 is not a temporary excursion outside of normal operating parameters. In this event, as indicated in step 400, the RMU determines whether the monitored parameter continuously operating outside the normal parameters is indicative of a more serious problem. If the determination in step 400 is that such operation is not indicative of a problem, then the diagnostics returns the RMU to its normal monitoring function in step 390. However, if the determination in step 400 is that the monitored data is indicative of a problem, the diagnostics then determines whether the data indicates that the unit is operating within a critical parameter in step 410 a predetermined limit programmed into the software diagnostics for the parameter monitored. A critical parameter, as that term is used herein, is one that (a) warrants a service request; (b) causes inefficient operation; or (c) operates in a manner that would lead to a failure. If the diagnostics determines that the operation is not within a critical parameter in step 410, then the determination is made whether the operation outside normal operational parameter is for a preselected period of time in step 420. Again, a predetermined limit programmed into the software diagnostics. If the determination is made that the operation outside of normal parameters has not exceeded a preselected period of time, as real-time operational data continues to be received, no new alarm is generated in step 350. If data indicates that operation has returned within normal operating parameters, the RMU returns to its normal monitoring functions in step 390.

The real-time data received by the RMU may continue to fall outside the normal operational parameters, but not within a critical parameter. Once the diagnostics in step 420 determines the data indicates that the operational parameters are outside normal operational parameters for greater than a predetermined time, a warning alarm is generated by the RMU in step 430. If at any time, the diagnostics software determines that the data received indicates that operation is within a critical parameter, a critical alarm is generated by the RMU in step 440.

Whenever the RMU generates a critical alarm in step 440 or a warning alarm in step 430, additional data is stored in memory indicating the respective alarm that was generated. The RMU then contacts the RMD in step 450. As the RMD is remotely located from the site of the equipment and hence remotely located from the RMU, the RMU may contact the RMD by opening any convenient line of communication that has been previously set up between the RMD and RMU to allow a transfer of information from the RMU to the RMD. This may be for example, a telephone or modem connection, an Internet or network connection, a wireless communication link or any other line of communication set up between the RMU and RMD.

The RMU, after establishing a line of communication with the RMD, sends identification information to the RMD so that the RMD can establish that the communication is legitimate and determine the geographic location of the RMU, and hence the location of the equipment being monitored. Other information concerning this equipment, such as the owner, the service technician, etc., may also be maintained or available to the RMD. Next, the RMU alerts the RMD that an alarm, either a warning alarm 430 or a critical alarm 440, has been generated. The RMU then downloads the data related to the alarm to the RMD. The RMD evaluates the information received from the RMU in step 470. The RMD then makes a determination whether action is required in step 480. If the RMD determines that no action is required, the communications is terminated in step 490. The RMU continues normal monitoring operations. The RMU diagnostics includes functions that recognize that the RMD has been contacted and provided with information regarding alarms for certain conditions and will not reinitiate communications with respect to these alarms until the RMU is reset at the site. However, further communications from the RMU to the RMD may be established if new alarms are generated.

When the RMD determines, in step 480, that action is required, the RMD can initiate remedial action in step 500. On reviewing the data, the RMD may make a determination that remedial action is required, but not enough information is available to determine what course of action should be followed. In this situation, the RMD may query the RMU. This query does not open a line of communication with the RMU. It can be an attempt or request to open a line of communication with the RMU. Thus, for example, the RMD may attempt to place a telephone call to the RMU. The RMU will recognize the phone number of the RMD and then open a line of communication between the RMU and RMD. Alternatively, the RMD may attempt to contact the RMU via the Internet, and the RMU will recognize the IP address of the RMD and then open a line of communication between the RMU and RMD. Any other method of querying the RMU may be utilized and these are only exemplary. Once the RMU recognizes that it has been queried by the RMD, it will open a line of communication with the RMD. When the line of communication has been established in response to a query from the RMD, the RMU will download information stored in its memory to the RMD. In addition, while in communication with the RMU, the RMD also can monitor the real-time data received by the RMU.

Once the RMD has received sufficient data from the RMU, the RMD can then decide upon the remedial action required. If the data indicates there has been a failure, or that immediate action is required to avoid a failure, then the RMD will take steps to determine who the responsible service technician is for the particular site at which the RMU is located and immediately notify the service technician. The RMD can identify the problem to the service technician and provide him with the data uploaded by the RMU. If the RMD determines that immediate remedial action is not required, the RMD can forward the data to the engineering services for an analysis and determination of the required remedial action.

Elaboration of all of the possible actions that engineering services may take is beyond the scope of this disclosure. However, engineering services may, if desired monitor the real-time data from the RMU through the RMD so that they may make a determination of the problem and course of action. As an example, engineering services may determine that, although a problem exists, an immediate fix is not required and correction can occur during the next routine maintenance. Engineering services can forward the information about the problem to the service technician for his use during the next service visit, and may include the data related to the operation of the equipment. In this manner, the service technician can arrive at the site where the equipment is located with the proper equipment, including any repair parts required, and can properly schedule the amount of time required for the service visit. As another example, engineering services may determine that the problem identified does not need immediate action, but that the corrective action cannot be delayed until the next routine maintenance. Engineering services can then notify the service technician to schedule a service visit, providing the technician with the information discussed above. Engineering services also can review the data to determine if there are any trends with the operation of the equipment at the particular site. Importantly, engineering services can accumulate data on identical or similar lines of equipment and analyze for trends and establish reliability information on the equipment.

The RMU can display the alarms, whether a normal alarm, step 360, a warning alarm step 430 or a critical alarm step 440. Furthermore, these alarms will remain on display until the RMU is reset by the service technician at the site on a service visit. During a service visit, the service technician can access the data stored in the memory of the RMU to evaluate the operation of the equipment, if desired. It is important to note that the MCIU or the microgateway is in one-way communication with the RMU, and the RMU is in one-way communication with the RMD. The RMU is not set up to receive information from the RMD. Thus, it is not possible for a computer hacker to gain access to the system to cause mischief. Thus, even though the present invention provides a way to remotely monitor operation of chillers and RTUs, there are two layers of safety to prevent such a hacker from gaining access to any software that may control the equipment operations. While the diagnostics software and settings of the RMU may be changed, and the RMU can even be loaded with new software, these modifications must be implemented on-site.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for monitoring the operation of an HVAC system comprising:

air conditioning system component;

a sensor attached to the air conditioning system component to monitor an operating condition of the component;

a remote monitoring unit located at a site of the HVAC system that receives a signal from the sensor indicative of the operating condition of the component;

a remote monitoring device located at a site remote from the location of the HVAC system in one-way communication with the remote monitoring unit, the communication initiated by the remote monitoring unit when the sensed operating condition of the component is within a critical parameter range, causing the remote monitoring unit to generate an alarm;

wherein the remote monitoring unit sends information associated with the component operating parameters to the remote monitoring device and whereby the remote monitoring device cannot communicate with the air conditioning system component whereby the remote monitoring device initiates remedial action by a third-party entity in response to the alarm.

2. The system of claim 1 wherein the remote monitoring unit includes means for storing the signal indicative of the operating condition of the component.

3. The system of claim 2 wherein the one-way communication between the remote monitoring unit and the remote monitoring device further includes the remote monitoring unit providing information about the monitored component to the remote monitoring device.

4. The system of claim 3 wherein the information provided includes component identification information.

5. The system of claim 3 wherein the information provided includes operating condition information stored in the means for storing.

6. The system of claim 3 wherein the information provided includes a real-time signal from the sensor.

7. The system of claim 3 wherein the remedial action by a third party entity includes notifying a service technician to implement corrective action and initiative any required repairs.

8. The system of claim 3 wherein the remedial action by a third party entity includes providing the information to a manufacturer of the HVAC system, wherein the HVAC system manufacturer can evaluate the information and initiate additional corrective action following evaluation.

9. The system of claim 2 wherein the remote monitoring unit is a programmable device.

10. The system of claim 9 wherein the programmable device is a computer.

11. The system of claim 9 wherein the remote monitoring unit includes software that evaluates the signals from the sensor and includes logic to determine when the signals indicate that the operating condition of the component is outside of normal operating parameters but not within a critical parameter range.

12. The system of claim 11 wherein the logic further determines when the signals indicate that the operating conditions of the component are outside the normal operating parameters for greater than a preselected time period, thereby generating a warning alarm.

13. The system of claim 1 wherein the air conditioning system component is a chiller assembly.

14. The system of claim 13 wherein the chiller assembly further includes a control panel in communication with the sensor to receive signals from the sensor.

15. The system of claim 14 further including a microgateway which receives signals from the sensor and provides the signal to the remote monitoring unit.

16. The system of claim 15 wherein the microgateway is connected to the control panel of the chiller assembly, receiving information from the sensors available at the control panel, and wherein the microgateway is in one way communication with the remote monitoring unit, providing the received information to the remote monitoring unit.

17. The system of claim 1 wherein the air conditioning system component is a rooftop unit.

18. The system of claim 17 further including a monitor control interface unit in communication with the sensor and receives signals from the sensor indicative of the operating condition of the component.

19. The system of claim 18 wherein the monitor control interface unit is in one way communication with the remote monitoring unit and provides the received signals from the sensor indicative of the operating condition of the component to the remote monitoring unit.

20. A system for monitoring the operation of an HVAC system comprising:

air conditioning system component;

a sensor attached to the air conditioning system component to monitor an operating condition of the component;

a remote monitoring unit located at a site of the HVAC system that receives a signal from the sensor indicative of the operating condition of the component, the remote monitoring unit capable of establishing a line of communication, the remote monitoring unit including means for storing the signals indicative of the operating condition of the component, diagnostics to evaluate the signals indicative of the operating condition of the component to determine whether the operating condition is within normal operational parameters, and means for generating an alarm when the operating condition is outside of normal operational parameters;

a remote monitoring device located at a site remote from the location of the HVAC system in communication with the remote monitoring unit, the communication initiated by the remote monitoring unit when the sensed operating condition of the component is within a critical parameter range, causing the remote monitoring unit to generate an alarm, the remote monitoring device in one-way communication with the remote monitoring unit, the remote monitoring device capable of receiving information from the remote monitoring unit over the line of communication indicative of the history and the operating condition of the component;

whereby the remote monitoring unit establishes a line of communication with the remote monitoring device when an alarm is generated; and whereby the remote monitoring device initiates remedial action by a third-party entity in response to the alarm.

21. The system of claim 20 wherein the component is a chiller assembly.

22. The system of claim 21 wherein the chiller assembly further includes a control panel in communication with the sensor to receive signals from the sensor.

23. The system of claim 22 further including a microgateway which receives signals from the sensor and provides the signal to the remote monitoring unit.

24. The system of claim 23 wherein the microgateway is connected to the control panel of the chiller assembly, receiving information from the sensor available at the control panel, and wherein the microgateway is in one way communication with the remote monitoring unit, providing the received information to the remote monitoring unit.

25. The system of claim 20 wherein the air conditioning system component is a rooftop unit.

26. The system of claim 25 further including a monitor control interface unit in communication with the sensor and receives signals from the sensor indicative of the operating condition of the component.

27. The system of claim 26 wherein the monitor control interface unit is in one way communication with the remote monitoring unit and provides the received signals from the sensor indicative of the operating condition of the component to the remote monitoring unit.

28. The system of claim 20 wherein the remote monitoring unit is a computer.

29. The system of claim 28 wherein the means for storing is an electronic memory.

30. The system of claim 28 wherein the means for storing is a disk drive.

31. The system of claim 20 wherein the remote monitoring device includes means to identify the remote monitoring unit to the remote monitoring device through a secure identification protocol to query the remote monitoring unit to establish a secure line of communication to download information stored in the means for storing.

32. A method for monitoring the operation of an HVAC system comprising the steps of:

providing an air conditioning system component;

attaching a sensor to the air conditioning components to monitor an operating condition of the component;

providing a remote monitoring unit at the site of the HVAC system, the remote monitoring unit equipped with diagnostic software and with memory;

sending a signal from the sensor indicative of an operating condition of the component to the remote monitoring unit, the remote monitoring unit diagnostic software determining whether the operating condition is within normal operating parameters;

storing information indicative of the signal in the memory;

providing a remote monitoring device, the remote monitoring device located at a site remote from the location of the HVAC system;

generating an alarm when the operating condition of the component is outside of normal operating conditions;

establishing a one-way line of communication from the remote monitoring unit to the remote monitoring device when an alarm is generated;

providing information indicative of the operating condition of the component to the remote monitoring device when the line of communication is established; and initiating remedial action by the remote monitoring device to alert a third-party entity to correct the condition causing the generation of the alarm.

33. The method of claim 32 wherein the information provided over the line of communication includes information indicative of real time operating conditions of the component.

34. The method of claim 32 wherein the information provided over the line of communication includes information stored in the memory.

35. The method of claim 32 wherein the step of providing the air conditioning system component includes providing a chiller assembly that includes a control panel, which received signals from the sensors.

36. The method of claim 35 further including a step of providing a microgateway connected between the control panel and the remote monitoring unit, the microgateway in one-way communication with the control panel and the remote monitoring unit so as to provide information indicative of the sensor signal from the control panel through the microgateway to the remote monitoring unit.

37. The method of claim 32 wherein the step of providing the air conditioning system component includes providing a rooftop unit.

38. The method of claim 35 further including a step of providing a monitor control interface unit an communication with the sensor which receives signals from the sensor indicative of the operating condition of the component, the monitor control interface unit connected to the remote monitoring unit and in one way communication with the remote monitoring unit so as to provide information indicative of the sensor signal to the remote monitoring unit.

* * * * *

UNITED STATES PATENT AND TRADEMARK OFFICE

CERTIFICATE OF CORRECTION

PATENT NO. : 6,955,302 B2
DATED : October 18, 2005
INVENTOR(S) : Erdman, Jr. Clair Ernest It is certified that error appears in the above-identified patent and that said Letters Patent is hereby corrected as shown below:

Column 4,
Line 15, "It is the" should be -- It is in the --.

Column 12,
Line 53, "an communication" should be -- in communication --.

Signed and Sealed this

Thirty-first Day of January, 2006

JON W. DUDAS
*Director of the United States Patent and Trademark Office*